United States Patent [19]

Underbrink et al.

[11] 4,441,232

[45] Apr. 10, 1984

[54] METHOD AND APPARATUS FOR REMOVING A FIBER FRACTION FROM SEED COTTON

[75] Inventors: Gary L. Underbrink, Kingsville; Lambert H. Wilkes, College Station, both of Tex.; Joseph K. Jones, Raleigh, N.C.

[73] Assignee: Cotton, Incorporated, New York, N.Y.

[21] Appl. No.: 332,845

[22] Filed: Dec. 21, 1981

[51] Int. Cl.[3] ..... D01B 1/06

[52] U.S. Cl. ..... 19/48 R; 19/50; 19/64.5

[58] Field of Search ..... 19/39–54, 19/64.5

[56] References Cited

U.S. PATENT DOCUMENTS

| | | | |
|---|---|---|---|
| 378,167 | 2/1888 | Jennings | 19/48 R |
| 560,263 | 5/1896 | Faulkner | 19/43 |
| 691,272 | 1/1902 | Kasmeier | 19/43 X |
| 841,385 | 1/1907 | Fordyce | 19/53 |
| 876,412 | 1/1908 | Thoens | 19/48 R |
| 1,279,565 | 9/1918 | McCoy | 19/39 |
| 3,302,246 | 2/1967 | Rionda | 19/5 |

FOREIGN PATENT DOCUMENTS

| | | | |
|---|---|---|---|
| 2504 | of 1863 | United Kingdom | 19/48 R |

*Primary Examiner*—Louis Rimrodt

*Attorney, Agent, or Firm*—Burns, Doane, Swecker & Mathis

[57] ABSTRACT

The present invention relates to a method and apparatus for recovering a fiber fraction from seed cotton. In a first embodiment of the present invention, a plurality of closely spaced, substantially parallel rollers are driven in a continuous path substantially perpendicular to the axes of the rollers. Seed cotton is deposited on a first side of the continuous path of rollers. At least one relatively large diameter nip roll is arranged in abutting engagement with a second side of the continuous path with the nip roll being fixed relative to the continuous path of the roller. A substantially constant quantity of air is drawn substantially straight between the rollers from the first to the second side of the continuous path in an area at least immediately upstream of the nip roll to aid in extending a fiber fraction between adjacent ones of the rollers. The nip roll is rotatably driven for separating the fiber fraction extended between the rollers by the air from the seed. In a further aspect of the present invention, a rotatable brush is arranged on the second side of the continuous path opposite to the deposited seed cotton. The brush is adapted both for aligning the fiber fraction between adjacent ones of the plurality of rollers and for cleaning the fiber fraction prior to nipping the fiber fraction between the nip roll and the rollers.

23 Claims, 3 Drawing Figures

ROTATION
21
23
25
26
27
28
29
31
33
35
37
39
41
43
45
46
47
49

ROTATION
21
23
25
26
27
28
29
31
33
35
37
39
41
43
46
47
49
51
53
55
57

METHOD AND APPARATUS FOR REMOVING A FIBER FRACTION FROM SEED COTTON

BACKGROUND AND SUMMARY OF THE PRESENT INVENTION

The present invention relates to a method and apparatus for processing seed cotton. More particularly, the present invention relates to a method and apparatus for recovering a fiber fraction from seed cotton.

Various arrangements for delinting or ginning cotton have been proposed. Such devices have included saw ginners which tend to tear or pull at the seed cotton to remove lint therefrom. It is often desirable to remove a long fiber fraction from the cotton seed separately from the remaining short fiber fraction. Such a division of fiber fractions is desirable depending upon the intended use of the lint and is not satisfactorily accomplished by the known devices. It is also desirable to remove a long fiber fraction without tearing or breaking a substantial portion of the long fibers. Accordingly, there has been a need within the cotton industry for a more effective method and apparatus for obtaining a long fiber fraction from the seed cotton.

One proposed device included a large, rotatable circular cage comprised of a plurality of smaller rollers arranged parallel to one another along the periphery of the large cage. At least one nip roll was arranged in contact with the outer periphery of the rollers of the cage. The cage was enclosed within a housing from which the air was constantly withdrawn. The seed cotton was fed to the inside of the cage and was picked up by the plurality of rollers which attempted to carry the seed cotton upwardly to the location of the nip roll. The apparatus proved to be ineffective for several reasons. In particular, the seed cotton did not tend to remain in contact with the rollers and a "snow storm" ensued within the cage. Such random movement of the seed cotton produced a substantially lower yield than anticipated and necessitated frequent stopping of the machine to clear the inside of the cage. One theory set forth for explaining the onset of the "snow storm" effect was that the air flow was turbulent throughout the cage roll and consequently the seed cotton was merely blown around within the cage roll.

In a further proposal, a nip roll was placed in contact with the inner periphery of the cage roller and solid shrouds were placed closely adjacent the outside periphery of the cage roll in the area surrounding the nip roll in an attempt to maintain the seed cotton properly in position on the outside of the rollers. With this arrangement, turbulence was apparently created under the shrouds which tubulence cause a portion of the long fiber fraction to be "blown" outwardly. Consequently, the long fiber fraction could not be removed by the nip roll and the yield obtained was unacceptably small.

It is an object of the present invention to provide an effective method and apparatus for removing substantially all of a fiber fraction of a predetermined length contained within seed cotton.

It is a further object of the present invention to remove a fiber fraction from seed cotton with a method and apparatus which are capable of processing large quantities of seed cotton in an expeditious manner.

Still a further object of the present invention is to provide a method and apparatus which remove a quantity of trash from the seed cotton prior to removing the fiber fraction and maintain the trash separate from the recovered fiber fraction.

These objects and others are accomplished by a method and apparatus according to the present invention. The apparatus includes a plurality of closely spaced substantially parallel rollers with each of the rollers being freely rotatable about its axis. An arrangement for driving the plurality of rollers in a continuous path substantially perpendicular to the axes of the rollers is also provided. Seed cotton is deposited on a first side of the path and at least one relatively large diameter nip roll is arranged in abutting engagement with a second side of the continuous path opposite the first side. A suction source for drawing air from the first side to the second side of the continuous path of the rollers is also provided for aiding in extending a portion of the fiber fraction between adjacent ones of the rollers. The suction source draws a substantially constant quantity of air substantially straight between the rollers in an area at least immediately upstream of the nip roll relative to the direction of movement of the continuous path. The nip roll is driven about its axis for separating the fiber fraction extended between the rollers by the suction source from the seed.

In a further embodiment of the present invention, a brush is arranged on the second side of the continuous path generally opposite to the location where the seed cotton is deposited. The brush is adapted to extend and align the fiber fraction between adjacent ones of the plurality of rollers to facilitate separation of the fiber fraction from the seed by the nip roll. In the preferred embodiment, the brush and the nip roll are adjustable relative to the continuous path in order to change the pressure therebetween and vary the quantity of fiber fraction removed Further, the brush is adapted to remove trash from the seed cotton. An arrangement is provided for ensuring that the trash removed remains separated from the fiber fraction removed by the nip roll.

Further, according to the present invention, a second nip roll is arranged downstream from the first nip roll on the second side of the continuous path. A device for agitating the seed cotton on the first side of the continuous path after removing the portion of the fiber fraction with the first nip roll is also provided. In a first embodiment, the device for agitating the seed cotton includes a rotatable roller frictionally engaging an edge of the continuous path of the rollers to thereby cause rotation of the rollers to agitate the seed cotton. In a second embodiment, the device for agitating the seed cotton includes a rotatable roller having a plurality of bristle-like projections adapted to engage the seed cotton and agitate the same.

A method for recovering a fiber fraction according to the present invention includes driving a plurality of spaced apart parallel rollers along a continuous path. Seed cotton is deposited on a first side of the continuous path and a substantially constant quantity of air is drawn substantially straight between the rollers from the first side to a second side of the continuous path to draw a portion of the fiber fraction between adjacent ones of the rollers. The fiber fraction is separated from the seed cotton by nipping the fiber fraction between the rollers and at least one rotatable nip roll arranged on the second side of the continuous path. In a further aspect of the method according to the present invention the fiber fraction is extended and aligned between adjacent ones of the rollers with a rotatable brush arranged on a second side of the continuous paths.

BRIEF DESCRIPTION OF THE DRAWINGS

Preferred embodiments of the present invention will be described in greater detail with reference to the accompanying drawings, wherein like members bear like reference numerals and wherein.

DETAILED DESCRIPTION OF THE PREFERRED EMBODIMENTS

Figure 1:
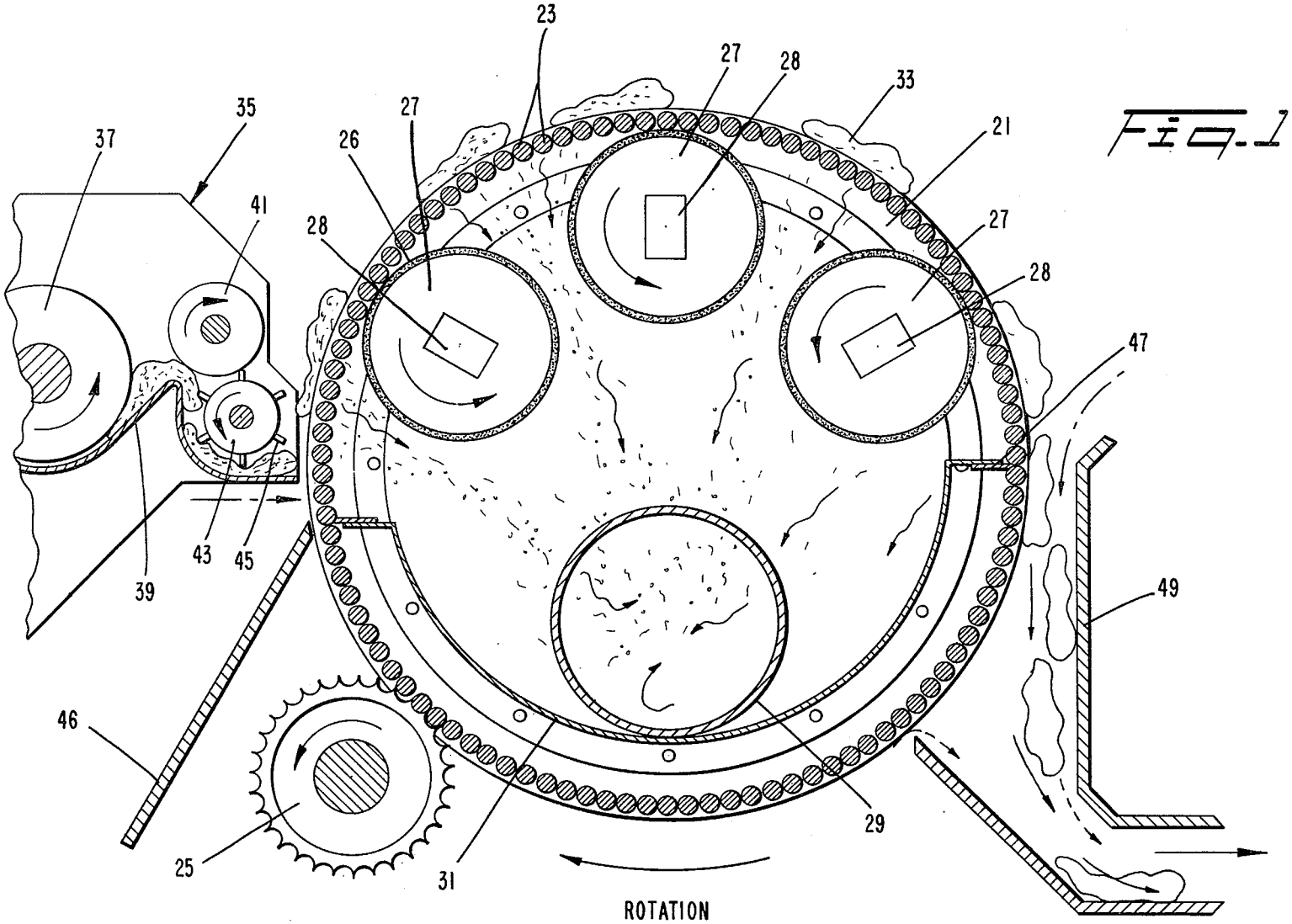
FIG. 1 is a cross-sectional view of a first embodiment of an apparatus according to the present invention.

With reference to FIG. 1, a first embodiment of an apparatus for recovering a fiber fraction from seed cotton includes a plurality of freely rotatable rollers 23 which define a continuous path perpendicular to the axes of the rollers 23. The rollers 23 are arranged in closely spaced parallel relationship to one another. In the embodiment of FIG. 1, each of the rollers 23 is mounted along the periphery of a circular rotatable cage 21 by any suitable arrangement which permits free rotation of the rollers about their axes. In other words, the continuous path is circular. It should be noted that a small space exists between adjacent rollers 23 such that the rollers do not contact one another. The rollers 23 may, for example be maintained in the proper continuous path by rotatably mounting the ends of the rollers 23 in a pair of parallel tracks or guides (not shown) on the cage 21 with suitable spacing being maintained between adjacent ones of the rollers 23. The cage 21 is supported in a suitable manner to permit rotation of the cage 21.

The cage 21 including the rollers 23 is rotated about a longitudinal axis by, for example, a wheel 25 having teeth which engage successive rollers 23. The toothed wheel 25 is driven by any suitable motor (not shown). Alternatively, the cage 21 may be held stationary such that the ends of the rollers "slide" within guide channels defining the continuous path by the action of the toothed wheel 25. In such an embodiment, suitable slider or roller bearings are preferably provided to permit free rotation of the rollers. Also, suitable spacers may be desirable to maintain the appropriate spacing between adjacent rollers 23.

Arranged within the cage 21 is at least one nip roll 27 (three of which are illustrated). Each of the nip rolls 27 has a diameter which is relatively large in comparison to the diameter of the individual rollers 23. An outer cylindrical peripheral surface portion of the nip rolls 27 abuts a lower side of the continuous path formed by the plurality of rollers 23 The nip rolls 27 may be sheathed with a suitable rubber-like material 26 to increase the friction between the nip roll 27 and the individual rollers 23. The axis of the nip roll 27 is preferably fixed relative to the direction of movement of the continuous path of the rollers 23. In a preferred embodiment, the pressure exerted between each of the nip rolls 27 and the individual rollers 23 is adjustable in a known manner by any suitable apparatus 28, such as adjusting the axle of the nip roll 27 within a slot. Each of the nip rolls 27 is driven about its axis by a suitable motor (not shown) which may be interconnected with the motor for driving the toothed wheel 25 if desired.

Also provided within the interior of the cage roll 21 is a duct 29 which is connected to a suitable source of suction pressure such as a fan (not shown). The suction created in the duct 29, causes a substantially constant quantity of air to be drawn from outside the cage roll 21 substantially straight between each of the plurality of rollers 23. In the embodiment illustrated in FIG. 1, the air flows substantially radially between the rollers 23. In this way, the air drawn through the rollers 23 creates a force on the outside surface of the rollers 23 which force tends to hold objects to the surface of the rollers 23. In a preferred embodiment, a flange 31 is arranged along substantially the lower half of the cage roll 21 to prevent suction pressure from being developed in this area. In other words, only an upper portion of the cage roll 21 is subjected to negative pressure created in the duct 29.

Seed cotton 33 is deposited on a first, outer surface of the cage roll 21 against the rollers 23 by a suitable feeding apparatus 35. In the illustrated embodiment, the feeding apparatus 35 includes a first feed roller 37 rotatably driven to pick up seed cotton from a supply (not shown) and to deliver the seed cotton along a wall flange 39 beneath a second feed roller 41 to a rotating toothed cylinder 43. Teeth 45 of the cylinder 43 are adapted to move the seed cotton toward the periphery of the cage roll 21. The seed cotton 33 is held against the rollers 23 on the periphery of the cage roll 21 by the suction pressure developed on the outside of the rollers 23 via the duct 29. It should also be noted that since the seed cotton is deposited on the upper half of the cage roll 21, the force of gravity acts generally in a direction to aid in maintaining the seed cotton 33 in contact with the rollers 23.

A deflecting flange 46 may be arranged beneath the feeding location of the feeding apparatus 35 to direct any seed cotton which is not held to the surface of the rollers 23 back toward the supply.

The suction force acting upon the seed cotton tends to draw at least a portion of the fiber fraction contained in the seed cotton 33 between adjacent ones of the plurality of rollers 23. Each of the rollers 23 has a diameter which is less than the length of the fiber fraction which is intended to be recovered such that the long fibers extend into the interior of the cage roll 21. As the seed cotton 33 moves along with the rotating cage roll 21, the fiber fraction extending between adjacent ones of the rollers 23 is nipped by the first nip roll 27 such that the extended fiber fraction is removed from the seed cotton 33. Since the spacing between adjacent rollers 23 is less than the diameter of the seeds, the fiber fraction is easily separated from the seed without also pulling the seed into the center of the cage roll 21.

While the present invention will be described with special reference to obtaining a long fiber fraction from the seed cotton 33, it is to be understood that by varying the diameter of the rollers 23 and the pressure between the nip rolls 27 and the rollers 23, varying lengths of fibers may be obtained by the method and apparatus according to the present invention. In this way. the present invention provides an arrangement for "selective" ginning according to the desired output fiber length.

The separated long fiber fraction is conveyed by the suction pressure developed within the duct 29 and removed from the apparatus through the duct 29. The long fiber fraction can be separated from the air by any suitable arrangement (not shown) arranged within the duct or at a further processing station.

After passing the first nip roll 27 the seed cotton continues along the periphery of the cage roll 21 and a further portion of the long fiber fraction may be drawn between the rollers by the suction pressure developed within the duct 29 to be nipped by the further nip roll 27. It should again be noted that the suction pressure developed within the cage roll 21 is of a substantially constant volume and is directed substantially straight between the rollers. The substantially straight air flow not only aids in maintaining the seed cotton 33 in contact with the rollers but also ensures that the long fiber fraction will remain extended between adjacent rollers 23. By pulling the air substantially straight between the rollers 23 from an inside location, turbulence within the areas immediately surrounding the nip rolls 27 is reduced and the effective-ness of the apparatus is substantially increased. As the seed cotton 33 progresses further around the cage roll 21, a further portion of the long fiber fraction may be nipped between the rollers 23 and the last illustrated nip roll 27. This further long fiber fraction is conveyed by the air into the duct 29 and separated from the air as explained above.

After passing the last nip roll 27, a tangent to the cage roll 21, and hence the remaining seed cotton, is in a generally vertical orientation Accordingly, the seed cotton 33 tends to drop by gravity away from the rollers 23 of the cage roll 21. Also, at this position the seed cotton 33 passes the location on the cage roll where an upper portion 43 of the isolating flange 31 is located and hence the suction pressure no longer acts upon the seed cotton 33. In a preferred embodiment, in order to assist the removal of the seed cotton from the cage roll 21, a duct 45 is arranged adjacent to the periphery of the cage roll 21 to further direct the seed cotton 33 in the desired direction. A fan (not shown) may be provided within the duct 45 for increasing the speed and efficiency of removal of the seed cotton 33 from the cage roll 21.

Figure 2:
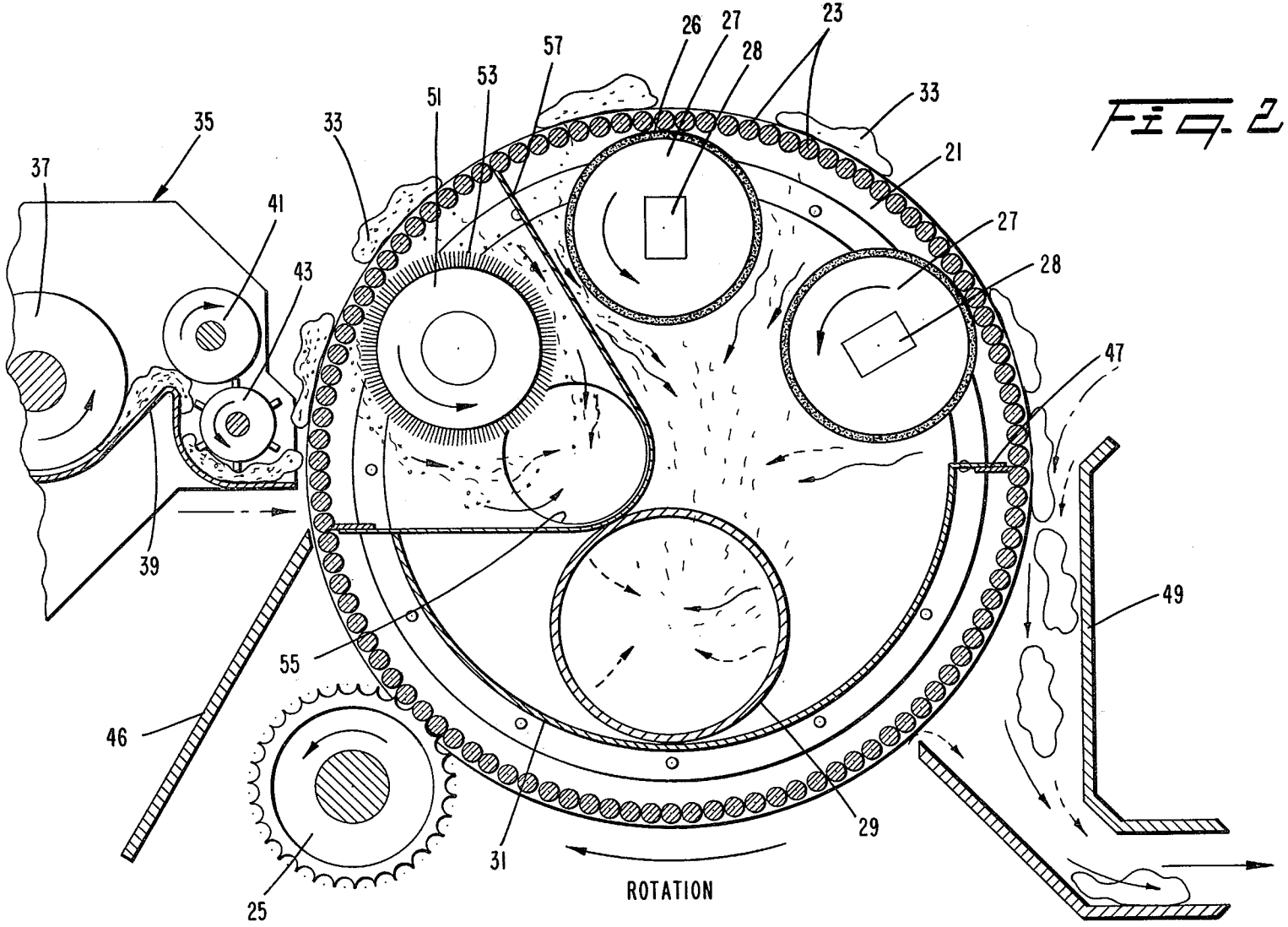
FIG. 2 is a cross-sectional view of a second embodiment of an apparatus according to the present invention.

A further aspect of the present invention provides an arrangement both for partially cleaning and further orienting the long fibers prior to nipping the long fiber fraction extending between adjacent rollers 23. With reference to FIG. 2, in the preferred embodiment, these objects are accomplished by a brush roller 51 rotatably driven by a suitable apparatus (not shown). The brush roller 51 includes a plurality of bristles 53 extending outwardly from the cylindrical surface of the roller 51. The roller 51 is fixed with respect to the path of the rollers and is rotatably driven about its axis. The ends of the bristles 53 are arranged to lightly contact an inside surface of the rollers 23. The pressure exerted between the brush roller 51 and the surface of the rollers 23 may be adjustable by a suitable apparatus (not shown).

The brush roller 51 is surrounded by an isolating flange 57 which extends from the cage roll flange 31 around the brush roller 51 to a location upstream of the first nip roll 27 relative to the direction of travel of the cage roll 21. Arranged within the isolating flange is a suction duct 55 which is connected to a suitable source of suction pressure (not shown).

The suction duct 55 creates within the portion of the cage roll 21 enclosed by the isolating flange 57 a suction pressure which tends to hold the seed cotton 33 on the outside of the rollers 23 and urges the long fiber fraction to extend between adjacent rollers 23. As the seed cotton 33 moves along the outside of the cage roll 21, the portion of the long fiber fraction extending between adjacent rollers 23 is contacted by the bristles 53 of the brush roller 51. The bristles tend to orient or align the long fiber fraction and to pull the long fibers further between the adjacent rollers 23. In addition, the bristles 53 of the brush roller 51 tend to comb the long fiber fraction and remove small particles of trash therefrom.

The trash is picked up by the suction developed within the duct 55 and transported by air to a remote location for disposal or suitable separation from the air and disposal. After being combed and oriented, the long fiber fraction which is still attached to the seed cotton moves toward the first nip roll 27. At this point, the operation of the device is similar to that described with reference to FIG. 1. However, due to the cleaning accomplished by the brush roller 51, the long fiber fraction separated from the air in the duct 29 is of higher quality. Also, due to the increased orientation of the long fiber fraction by the brush roller 51, the yield is further increased. It should be noted that the isolating flange 57 ensures that the trash will not become entrained with the long fiber fraction separated from the seed cotton 33 by the nip rolls 27.

While the direction of rotation of the nip rolls 27 and the brush roller 51 as illustrated is opposite to the direction of rotation of the cage roll 21, it is to be understood that direction of rotation is not believed to be critical. In other words, the brush roller and/or the nip rolls 27 may be driven in the same direction as the cage roller 21 without an appreciable change in the quantity or quality of the recovered fiber fraction. Again, it should be noted that the efficiency of the apparatus according to the present invention is greatly enhanced by providing a substantially constant flow of air substantially straight between the rollers 23 of the cage roller 21. By minimizing the amount of turbulence created along the surface of the cage roll 21, it is further ensured that the seed cotton 33 will remain in contact with the rollers 23 and that the long fiber fraction will extend between the rollers to be nipped by the nip rolls 27.

Figure 3:
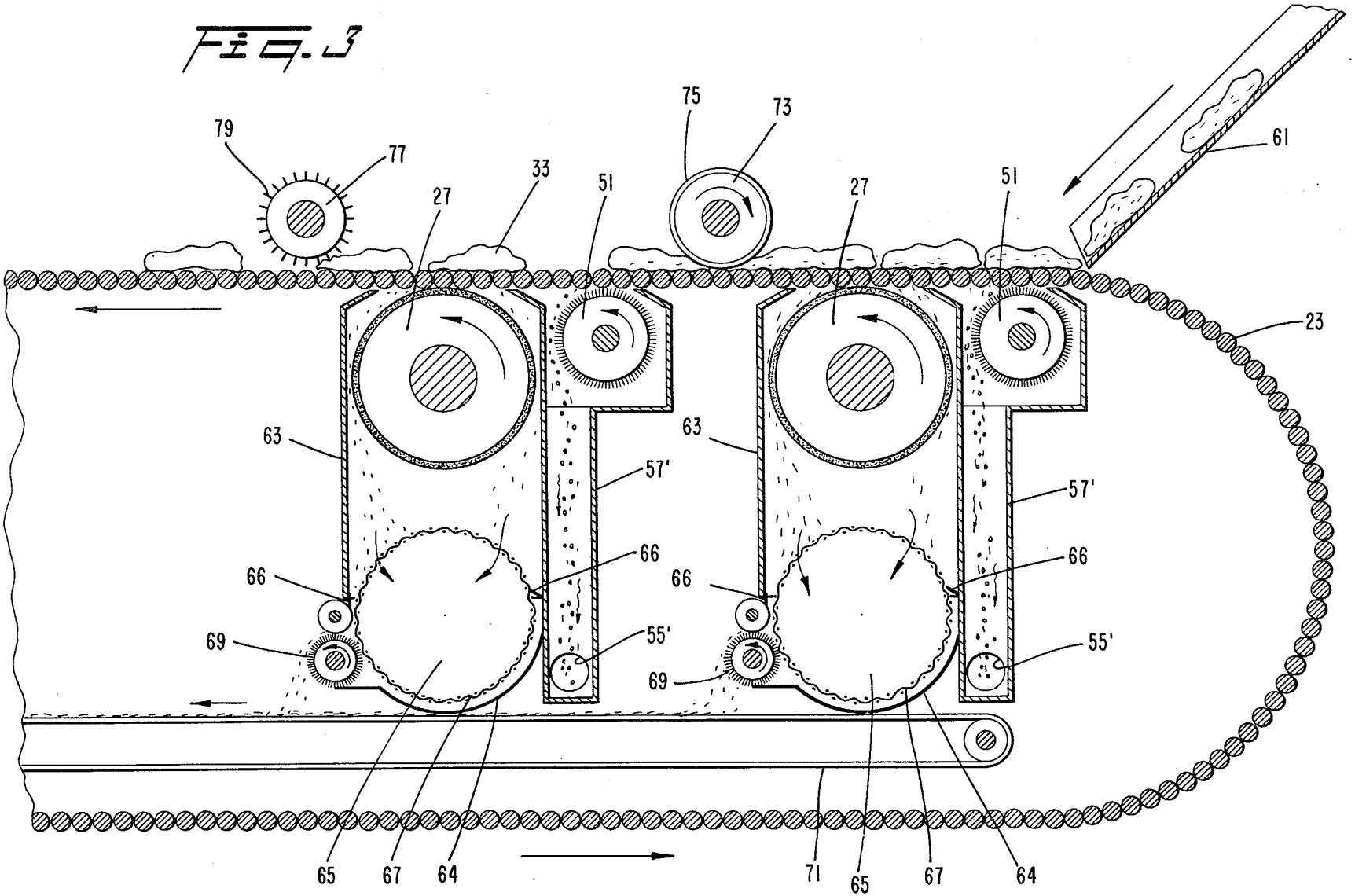
FIG. 3 is a cross-sectional view of a third embodiment of an apparatus according to the present invention

In a further embodiment of the present invention and with reference to FIG. 3, the continuous path of rollers 23 is arranged in an elongated manner. In other words, the plurality of rollers 23 are arranged to be driven in a continuous path somewhat similar to an endless conveyor belt. With this arrangement, a simple chute 61 may be provided for depositing the seed cotton 33 upon a first, upper side of the continuous path of the rollers 23. It should be noted that in the arrangement according to FIG. 3 the seed cotton 33 remains in contact with the rollers 23 under the influence of gravity at all times. In other words, the suction pressure required to maintain the seed cotton 33 in contact with the rollers is less than that required in the embodiments according to FIGS. 1 and 2. Also, a longer processing path, i.e. more brush rollers 51 and nip rolls 27 may be provided along the level upper path of the rollers 23.

A slightly modified form of isolating baffle 57' is provided for surrounding the brush roller 51 and a duct 55' for creating suction. The precise shape of the isolating baffle 57' is not critical. The important feature is that the suction is created in an area or zone immediately adjacent the brush roller 51. Also, the baffle 57' is arranged to ensure that the trash removed by the brush roller 51 remains separated from the long fiber fraction which is removed by the nip rolls 27. Also, it should be noted that in order to maintain a substantially straight flow of air between the rollers 23, the air flow is arranged to flow between the rollers in a direction substantially perpendicular to the upper portion of the continuous path of the rollers 23.

With further reference to FIG. 3, the suction created around the nip rolls 27 is confined within an area closely adjacent to the nip between the nip roll 27 and the rollers 23 by suitable isolating ducts 63. The suction is developed around the nip roll 27 by for example, a fan drawing air through a hollow rotatable cylinder 65 arranged beneath each of the nip rolls 27. The cylinder is enclosed by, for example, a fine mesh screen 67 which permits the passage of air but prohibits the passage of the long fiber fraction removed by the nip roll 27. Also a suitable shroud 64 is arranged adjacent a lower circumferential portion of the screened roll 65 to prevent air flow into the roll 65 along the lower portion. In addition, seals 66 are preferably provided at various locations along the circumference of the roll 65 to aid in both preventing unwanted air flows and sealing the isolating ducts from the outside air.

The long fiber fraction which is held in contact with the outer surface of the roll 65 along the screen 67 is removed therefrom by a suitable doffing cylinder 69 arranged at a lower portion of the rotatable hollow cylinder 65. The long fiber fraction lint removed from the screen 67 of the hollow cylinder 65 is dropped onto an endless conveyor belt 71 arranged to transport the recovered long fiber fraction to further suitable processing (not shown). As seen in FIG. 3, only two complete trash and long fiber fraction removal stations are provided. It is to be understood that any number of such stations may be provided as desired.

In a further aspect of the present invention, an arrangement is provided between successive stations to agitate the seed cotton 33 on the rollers 23 such that a further portion of the long fiber fraction contained within the seed cotton 33 may be extended between adjacent rollers 23 to be nipped by the rolls 27. Two different forms of such an agitating arrangement are illustrated in FIG. 3.

The agitating arrangement may include a cylinder 73 rotatably driven by a suitable source (not shown). The cylinder 73 includes at least one annular, preferably rubber, ring 75 which engages an edge of the continuous path of the rollers 23. The annular ring 75, of which two are preferably provided with one at each edge of the path of the rollers 23, serve two functions. The primary function of the annular ring 75 is to rotate the rollers 23 as they pass therebeneath to thereby cause an agitating effect upon the seed cotton 33 carried by the rollers 23. Further, the rings 75 elevate the cylinder 73 sufficiently above the major, central portion of the continuous path of the rollers 23 such that the seed cotton 33 can pass therebeneath while being agitated by the rotation of the rollers 23.

A second embodiment of an agitating arrangement according to the present invention includes a rotatable cylinder 77 having a plurality of bristle-like projections 79 along an outer peripheral surface thereof. The ends of the bristle-like projections are spaced from the upper surface of the rollers 23 but are sufficiently close thereto to contact the seed cotton 33 as the seed cotton passes therebeneath. In this way, the seed cotton is directly agitated as the seed cotton passes under the roller 77 rather than indirectly agitated by causing rotation of the rollers 23 as in the embodiment utilizing the cylinder 73 with the annular rings 75. Either of the disclosed embodiments for agitating the seed cotton is effective to cause a further portion of the long fiber fraction contained within the seed cotton 33 to be directly downwardly and to be positioned to be pulled between adjacent rollers 23 by the suction pressure and combed by the brush roller 51.

It should be noted that although a further processing station is not illustrated in FIG. 3, it is to be understood that a further processing station is preferred after the seed cotton 33 passes the agitating cylinder 77. Once the seed cotton has been thoroughly processed in the apparatus the seed cotton is removed by a doffing arrangement similar to that shown in FIGS. 1 and 2.

The operation of the embodiment according to FIG. 3 is substantially the same as that described with reference to FIGS. 1 and 2. In addition to the combing and nipping steps, the seed cotton 33 is agitated by the cylinder 73 or 77 to permit a further long fiber fraction to be nipped at the subsequent nip roll 27.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. Apparatus for removing a fiber fraction from seed cotton comprising:

a plurality of closely spaced substantially parallel rollers, each of the rollers being freely rotatable about its axis;

means for driving said plurality of rollers in a continuous path substantially perpendicular to the axes of the rollers;

means for depositing seed cotton on a first side of the continuous path;

at least one relatively large diameter nip roll, a continuous outer peripheral surface portion of the nip roll being arranged in abutting engagement with the rollers on a second side of the continuous path opposite said first side, said at least one nip roll being fixed relative to the continuous path of the rollers;

suction means for drawing air from the first side to the second side of the path of the rollers, said air aiding in extending a portion of the fiber fraction between adjacent ones of said rollers, said suction means drawing a substantially constant quantity of air substantially straight between the rollers in an area at least immediately upstream of the nip roll relative to the direction of movement of the continuous path; and means for driving said at least one nip roll about an axis thereof for separating the fiber fraction extended between the rollers by the suction means from the seed.

2. The apparatus according to claim 1, wherein said continuous path is circular and the air is drawn substantially radially between said rollers.

3. The apparatus according to claim 1, wherein said continuous path includes at least one straight portion having the at least one nip roll arranged therein, and wherein said air is drawn between said rollers in a direction substantially perpendicular to the straight portion.

4. The apparatus according to claim 1, further comprising brush means for aligning the fiber fraction between adjacent ones of said rollers, said brush means being arranged on the first side of the continuous path upstream from said at least one nip roll relative to the direction of movement of the continuous path.

5. Apparatus for removing a long fiber fraction from seed cotton comprising:

a plurality of rollers arranged parallel to one another in a continuous path;

means for driving said plurality of rollers along said continuous path;

chute means for depositing seed cotton containing a fiber fraction on a first side of the continuous path;

brush means arranged on a second side of the continuous path for aligning a portion of the fiber fraction between adjacent ones of the rollers;

at least one relatively large diameter nip roll arranged with an outer cylindrical surface portion in abutting engagement with the second side of the continuous path downstream from the brush means; and means for rotating said at least one nip roll for separating the fiber fraction aligned between adjacent rollers by the brush means from the seed.

6. The apparatus according to claim 5, wherein said brush means comprises a cylinder, means for rotatably driving said cylinder, said cylinder having a plurality of bristles extending from an outer cylindrical surface portion and lightly contacting said second side of the continuous path of rollers.

7. The apparatus according to claim 5, wherein each of the rollers is freely rotatable about its axis.

8. The apparatus according to claim 5, further comprising suction means for drawing air from the first side to the second side of the continuous path, said suction means drawing a substantially constant quantity of air substantially straight between adjacent ones of said rollers in at least a zone immediately adjacent an upstream portion of the nip roll relative to the direction of movement of the continuous path.

9. The apparatus according to claim 5, wherein the brush means removes trash material from the seed cotton, and further comprising means for collecting said removed trash material and for maintaining said trash material separate from the recovered fiber fraction.

10. The apparatus of claim 1 or 5, wherein the rollers are spaced sufficiently far apart to permit air and the fiber fraction to extend between adjacent rollers, said rollers being sufficiently close together to prevent the seeds from passing therebetween.

11. The apparatus according to claim 1 or 5, further comprising means for collecting the fiber fraction separated from the seed cotton.

12. The apparatus according to claim 1 or 5, further comprising means for adjusting the abutting engagement pressure between the at least one nip roll and the rollers.

13. The apparatus according to claim 1 or 5, further comprising doffing means for removing the seed cotton from the first side of the continuous path after passing the at least one nip roll.

14. The apparatus according to claim 13, wherein the doffing means includes means for creating negative pressure on the first side of continuous path downstream from the at least one nip roll.

15. The apparatus according to claim 1 or 5, further comprising:

a second nip roll arranged downstream from the at least one nip roll on said second side of the continuous path; and means for agitating the seed cotton on the first side after removing a portion of the fiber fraction with the at least one nip roll and before passing the second nip roll.

16. The apparatus according to claim 15, wherein the means for agitating the seed cotton comprises a rotatable roller frictionally engaging the rollers on at least one edge of the continuous path, said roller causing rotation of the plurality of rollers to agitate the seed cotton.

17. The apparatus according to claim 15, wherein the means for agitating the seed cotton comprises a rotatable roller arranged on the first side of the path and having a plurality bristle-like projections adapted to engage the seed cotton to agitate the same.

18. A method for removing a fiber fraction from seed cotton comprising the steps of:

driving a plurality of spaced apart parallel rollers along a continuous path;

depositing seed cotton on the rollers on a first side of the continuous path;

drawing a substantially constant quantity of air substantially straight between the rollers from the first side to a second side of the continuous path to extend a portion of the fiber fraction between adjacent ones of the rollers; and separating the fiber fraction extended between adjacent rollers from the seed cotton by nipping the fiber fraction between the rollers and a continuous outer peripheral surface portion of at least one rotatable nip roll arranged on the second side of the continuous path, said surface portion being arranged in abutting engagement with the rollers on a second side of the continuous path.

19. A method for removing a fiber fraction from seed cotton comprising the steps of:

driving a plurality of spaced apart parallel rollers along a continuous path;

depositing seed cotton on the rollers on a first side of the continuous path;

extending and aligning a portion of the fiber fraction between adjacent ones of said rollers with a rotatable brush arranged on a second side of the continuous path and contacting the surface of the rollers; and separating the portion of the fiber fraction extending between the rollers from the seed cotton by nipping the fiber fraction between the rollers and at least on nip roll arranged on the second side of the continuous path in abutting engagement with the rollers.

20. The method in accordance with claim 19, further comprising:

removing a quantity of trash material with the rotatable brush;

collecting the removed quantity of trash material; and maintaining the quantity of trash material separate from the recovered fiber fraction.

21. The method in accordance with claim 18 or 19, further comprising the steps of:

agitating the seed cotton on the first side of the continuous path after separating the fiber fraction to permit a further portion of the fiber fraction to extend between the rollers; and separating the further portion of the fiber fraction by nipping the further fiber fraction between the rollers and a second nip roll arranged on the second side of the continuous path.

22. The method in accordance with claim 18 or 19, further comprising adjusting the pressure between the at least one nip roll and the rollers.

23. The method in accordance with claim 18 or 19, further comprising doffing the seed cotton from the continuous path after removing the fiber fraction.

* * * * *